US011732930B2

(12) United States Patent
Miyata et al.

(10) Patent No.: US 11,732,930 B2
(45) Date of Patent: Aug. 22, 2023

(54) COOLING CONTAINER TO WHICH REFRIGERATOR IS ATTACHABLE

(71) Applicant: JAPAN SUPERCONDUCTOR TECHNOLOGY INC., Hyogo (JP)

(72) Inventors: Hitoshi Miyata, Kobe (JP); Satoshi Ito, Kobe (JP); Hirochika Watanabe, Kobe (JP)

(73) Assignee: JAPAN SUPERCONDUCTOR TECHNOLOGY INC., Hyogo (JP)

( * ) Notice: Subject to any disclaimer, the term of this patent is extended or adjusted under 35 U.S.C. 154(b) by 344 days.

(21) Appl. No.: 17/272,696

(22) PCT Filed: Jul. 31, 2019

(86) PCT No.: PCT/JP2019/030052
§ 371 (c)(1),
(2) Date: Mar. 2, 2021

(87) PCT Pub. No.: WO2020/049908
PCT Pub. Date: Mar. 12, 2020

(65) Prior Publication Data

US 2021/0356176 A1 Nov. 18, 2021

(30) Foreign Application Priority Data

Sep. 3, 2018 (JP) ..... 2018-164539

(51) Int. Cl.
*F25B 9/10* (2006.01)
*F25B 9/14* (2006.01)
*H01F 6/04* (2006.01)

(52) U.S. Cl.
CPC ..... *F25B 9/10* (2013.01); *F25B 9/14* (2013.01); *H01F 6/04* (2013.01)

(58) Field of Classification Search
CPC ..... F25B 9/10; F25B 9/14; H01F 6/04
See application file for complete search history.

(56) References Cited

U.S. PATENT DOCUMENTS

2019/0101244 A1* 4/2019 Strobel ..... F17C 3/08

FOREIGN PATENT DOCUMENTS

JP H09-287838 A 11/1997
JP 2004-053068 A 2/2004

OTHER PUBLICATIONS

International Search Report issued in PCT/JP2019/030052; dated Oct. 21, 2019.

* cited by examiner

*Primary Examiner* — Nael N Babaa
(74) *Attorney, Agent, or Firm* — Studebaker & Brackett PC

(57) ABSTRACT

Provided is a cooling container, that includes a container body, a first cooling target terminal, a second cooling target terminal, a cylinder holder raised and lowered while holding a cylinder in a posture where first and second lower surfaces of first-stage and second-stage cold heads of the refrigerator are opposed to first and second cooling target surfaces of the first and the second-stage cold heads, respectively, a second raising and lowering mechanism raising and lowering the cylinder holder between a position where the second lower surface contacts the second cooling target surface and a position thereabove, and a first raising and lowering mechanism raising and lowering the first cooling target terminal between a position where the first lower surface contacts the first cooling target surface and a position therebelow.

11 Claims, 10 Drawing Sheets

COOLING CONTAINER TO WHICH REFRIGERATOR IS ATTACHABLE

TECHNICAL FIELD

The present invention relates to a cooling container for containing an cooling object and supporting a refrigerator to enable the cooling object to be cooled by the refrigerator.

BACKGROUND ART

As a cryogenic apparatus for cooling an cooling object, such as a superconducting magnet and a liquid helium container for containing the superconducting magnet, conventionally known is one including a cooling container and a two-stage type refrigerator attached thereto. The cooling container includes: a container body (vacuum container) for containing, in a vacuum state, a first cooling object and a second cooling object for which a target cooling temperature lower than that of the first cooling object is set; a refrigerator support part for supporting the refrigerator; a first cooling target terminal; and a second cooling target terminal. The first cooling object is, for example, a heat shield container enclosing a superconducting coil inside the container body, and the first cooling target terminal is heat-transferably connected to the first cooling object through a heat-transfer member. The second cooling object is, for example, the superconducting coil, and the second cooling target terminal is heat-transferably connected to the second cooling object through a heat-transfer member. On the other hand, the two-stage type refrigerator has a first-stage cold head for which a first cooling temperature is set and a second-stage cold head for which a second cooling temperature lower than the first cooling temperature is set, being attached to the container body so as to bring the first-stage cold head into contact with the first cooling target terminal and so as to bring the second-stage cold head into contact with the second cooling target terminal.

As the two-stage type refrigerator, known is, for example, a refrigerator disclosed in Patent Literature 1. The refrigerator includes a displacer, a cylinder that houses the displacer reciprocatably, and a driving part for reciprocating the displacer to generate cold head. The displacer includes a first displacer and a second displacer, and the cylinder includes a first cylinder that houses the first displacer and a second cylinder that houses the second displacer. The first displacer and the first cylinder constitute the first-stage cold head, and the second displacer and the second cylinder constitute the second-stage cold head.

The refrigerator needs to be properly detached from the container body for maintenance thereof. As a method for allowing the refrigerator to be smooth attached and detached while keeping a low temperature in the cooling container. Patent Document 1 discloses a method including the following matters.

(1) A sleeve is provided in the cooling container, and the refrigerator is inserted into the sleeve. The sleeve serves as a heat-transfer medium for cooling an cooling object in the cooling container by the refrigerator.

(2) To detach the refrigerator from the cooling container, first, the cylinder of the refrigerator is pulled up by just a significantly small pull-up amount from the sleeve. The pull-up amount is an amount that allows the heat-transfer between the sleeve and the refrigerator to be cut off while keeping a seal by an O-ring interposed between the sleeve and the refrigerator (that is, keeping the vacuum inside the container), being 2 to 3 mm according to the description of Patent Literature 1.

(3) in a state of cutting off the heat-transfer between the cylinder and the sleeve of the refrigerator as described in (2), only a displacer and a driving part are pulled out while leaving the cylinder, and ice and frost adhered to the inner surface due to exposure of the inner surface of the cylinder to the atmosphere are heated by a heating device to be removed.

(4) After the removal of the ice and the frost as described in (3), the displacer for which a maintenance has been already performed is re-inserted into the cylinder and the cylinder is lowered to come into contact with the sleeve to be returned into the heat-transferable state.

In the apparatus disclosed in Patent Literature, however, the interposition of the sleeve between the refrigerator and the cooling object causes the apparatus to have a large size and further reduces the efficiency of cooling of the cooling object by the refrigerator. Besides, in order to achieve normal cooling, it is necessary to bring the sleeve and the cylinder of the refrigerator into contact with each other at a sufficient contact pressure, whereas no specific means therefor is shown. Moreover, in order to cut off the heat-transfer between the sleeve and the cylinder of the refrigerator while keeping a sealed state by the O-ring between the sleeve and the cylinder, the cylinder has to be pulled up accurately by a very limited amount, which operation is not easy.

CITATION LIST

Patent Literature

Patent Literature 1: Japanese Unexamined Patent Publication No. 2004-053068

SUMMARY OF INVENTION

An object of the present invention is to provide a cooling container for containing an cooling object and supporting a refrigerator to allow the cooling object to be efficiently cooled by the refrigerator and to allow the maintenance of the refrigerator to be easily performed.

Provided is a cooling container that contains a first cooling object and a second cooling object for which a target cooling temperature lower than that of the first cooling object is set, the cooling container configured to support a refrigerator including a cylinder, a displacer inserted into the cylinder reciprocably and detachably from the cylinder, and a drive unit that reciprocates the displacer to generate cold heat, the displacer and the cylinder constituting a first-stage cold head having a first operation temperature and a second-stage cold head having a second operation temperature lower than the first operation temperature and aligned axially with the first-stage cold head, to allow the first cooling object and the second cooling object to be cooled by the first-stage cold head and the second-stage cold head, respectively. The cooling container includes: a container body that contains the first cooling object and the second cooling object while keeping a vacuum state; a first cooling target terminal that is disposed in the container body while being heat-transferably connected to the first cooling object, the first cooling target terminal having a first cooling target surface that is opened upward; a second cooling target terminal that is disposed in the container body while being heat-transferably connected to the second object and being raiseable and lowerable, the second cooling target terminal having a second cooling target surface that is opened upward at a position below the first cooling target surface; a cylinder holder supported by the container body so as to be raiseable and lowerable with the cylinder while holding the cylinder in a posture where a lower surface of the first-stage cold head and a lower surface of the second-stage cold head are vertically opposed to the first cooling target surface and the second cooling target surface, respectively; a holder seal part interposed between the container body and the cylinder holder to hermetically seal the container body while allowing the cylinder holder be raised and lowered relatively to the container body; a second raising and lowering mechanism connected to the cylinder holder to raise and lower the cylinder holder between a second heat-transfer position where the lower surface of the second-stage cold head comes in contact with the second cooling target surface to allow heat-transfer between the second-stage cold head and the second cooling target terminal and a second cut-off position where the lower surface of the second-stage cold head is separated upward from the second cooling target surface to cut off the heat-transfer between the second-stage cold head and the second cooling target terminal; and a first raising and lowering mechanism connected to the first cooling tartlet terminal to raise and lower the first cooling target terminal between a first heat-transfer position where the first cooling target surface comes in contact with the lower surface of the first-stage cold head which is located at a height position corresponding to the second heat-transfer position to allow heat-transfer between the first-stage cold head and the first cooling target terminal and a first cut-off position where the first cooling target surface is separated downward from the lower surface of the first-stage cold head to cut off the heat-transfer between the first-stage cold head and the first cooling target terminal.

DESCRIPTION OF EMBODIMENTS

Preferred embodiments of the present invention will be described with reference to the drawings.

Figure 1:
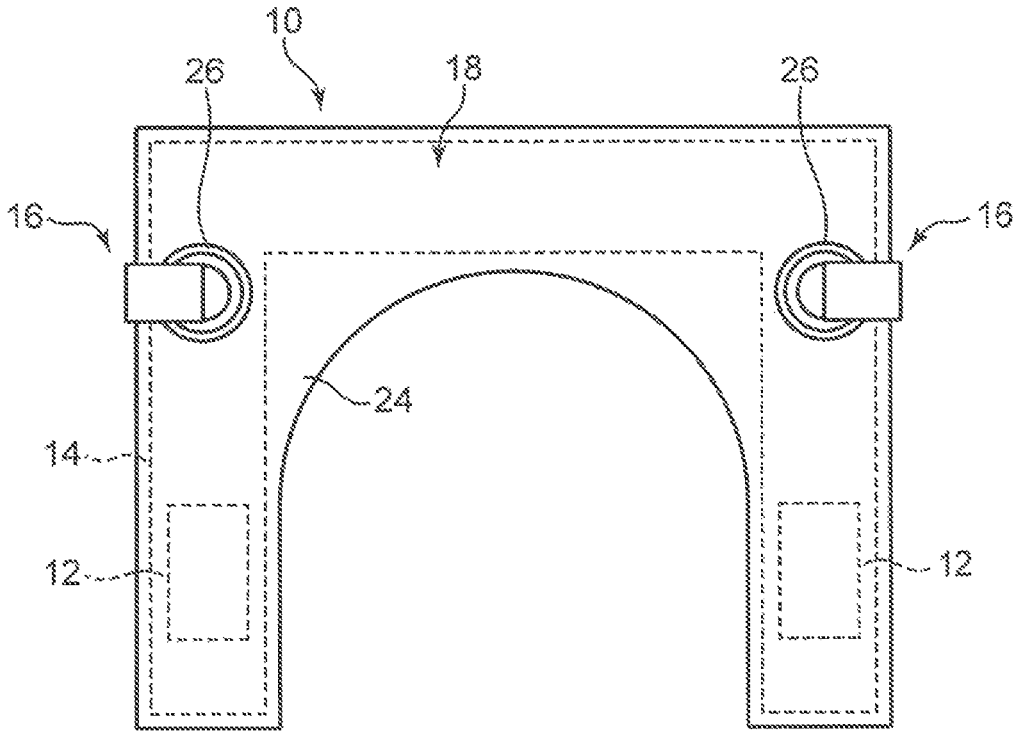
FIG. 1 is a plan view showing a cryogenic apparatus including a cooling container according to an embodiment of the present invention.
Figure 2:
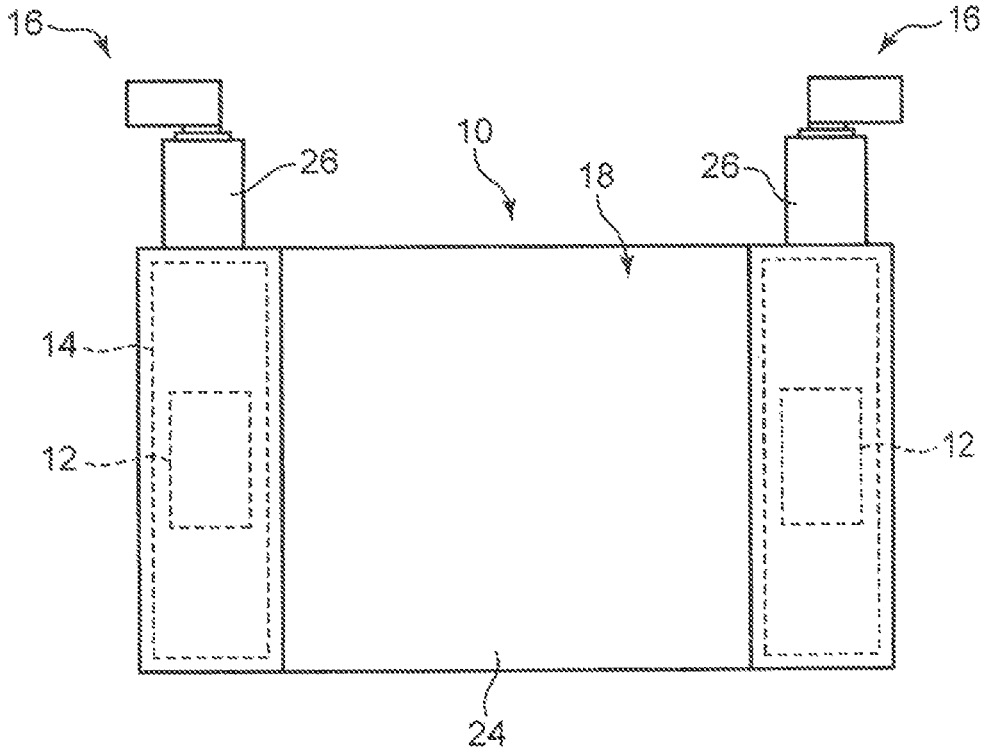
FIG. 2 is a front view showing the cryogenic apparatus.

FIGS. 1 and 2 show an entire cryogenic apparatus including a cooling container 10 according to the embodiment. The cryogenic apparatus includes the cooling container 10, a pair of superconducting coils 12 contained in the cooling container 10, a heat shield container 14 contained in the cooling container 10, and a pair of refrigerators 16 attached to the cooling container 10.

The pair of superconducting coils 12, each being a cooling object corresponding to the "second cooling object" according to the present invention, are supported by a not-graphically-shown frame so as to keep an interval between the pair of superconducting coils 12. The frame has a substantial U-shape in plan view that includes a pair of holding portions that hold the pair of superconducting coils 12 and a connection portion that interconnects the pair of holding portions.

The heat shield container 14 is a cooling object corresponding to the "first cooling object" according to the present invention, having a shape enclosing the pair of superconducting coils 12 and the frame. The cooling container 10 contains the heat shield container 14 and the pair of superconducting coils 12 inside the heat shield container 14. The cooling container 10 supports the pair of refrigerators 16 to be attached to the cooling container 10 and enables the pair of refrigerators 16 to cool the pair of superconducting coils 12, respectively.

The pair of refrigerators 16 cool the pair of superconducting coils 12 to respective predetermined target cooling temperatures (for example, 4K) to bring them into transition to a superconducting state, and cool the heat shield container 14 to a predetermined target cooling temperature (for example, 40 K) higher than the target cooling temperature of the pair of superconducting coils 12 to restrict heat intrusion into the superconducting coils 12. The pair of superconducting coils 12 form a strong horizontal magnetic field between the pair of superconducting coils 12 by receiving a large current thereto in the superconducting state. The horizontal magnetic field is used, for example, for removal of impurities in a semiconductor single crystal that is being pulled cylindrically from a crucible, NMR, and the like.

The specific shape and use of the cooling container according to the present invention are not limited to those described above. In other words, the type and number of the first and second cooling objects to be contained in the cooling container are not limited to those described above. For example, the cooling container according to the present invention can be applied to a doughnut-shaped vacuum container that contains a single superconducting coil for MRI.

Figure 3:
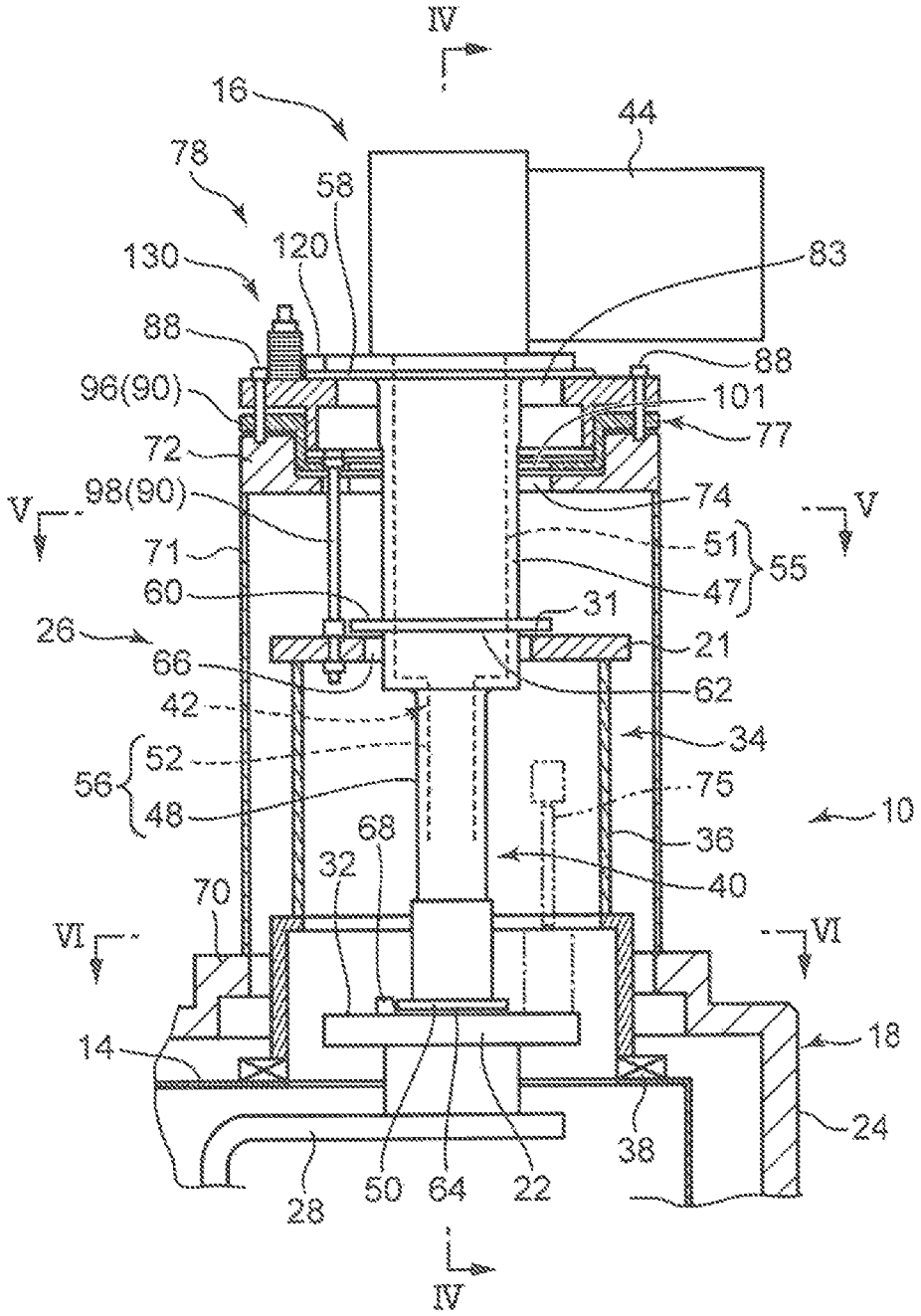
FIG. 3 is a cross-sectional front view showing a main part of the cryogenic apparatus including a refrigerator and a refrigerator support part for supporting the refrigerator.
Figure 4:
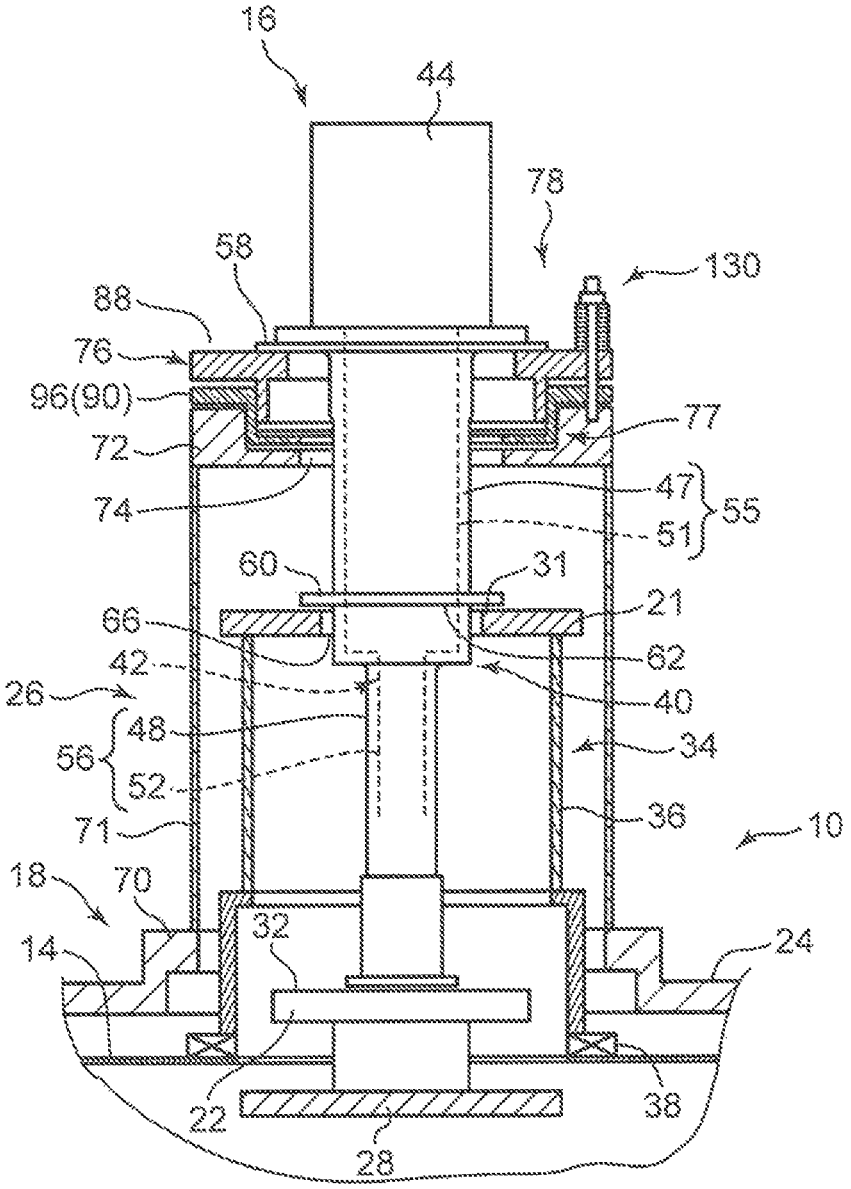
FIG. 4 is a side view showing a cross section taken along the line IV-IV in FIG. 3.
Figure 5:
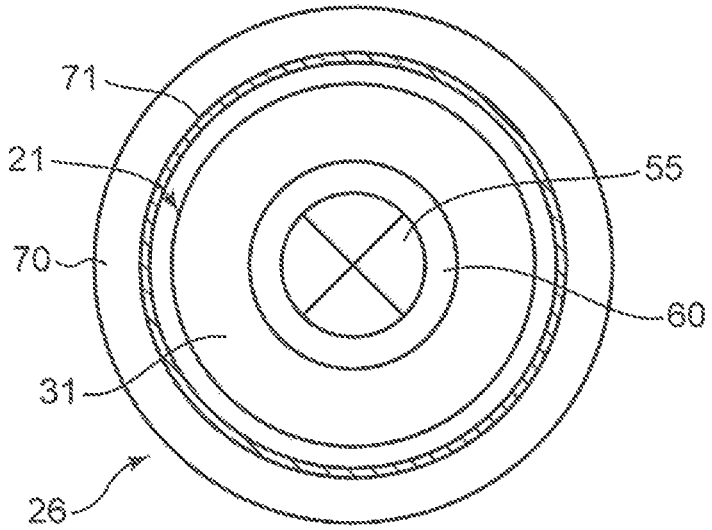
FIG. 5 is a plan view showing a cross section along the line V-V in FIG. 3.
Figure 6:
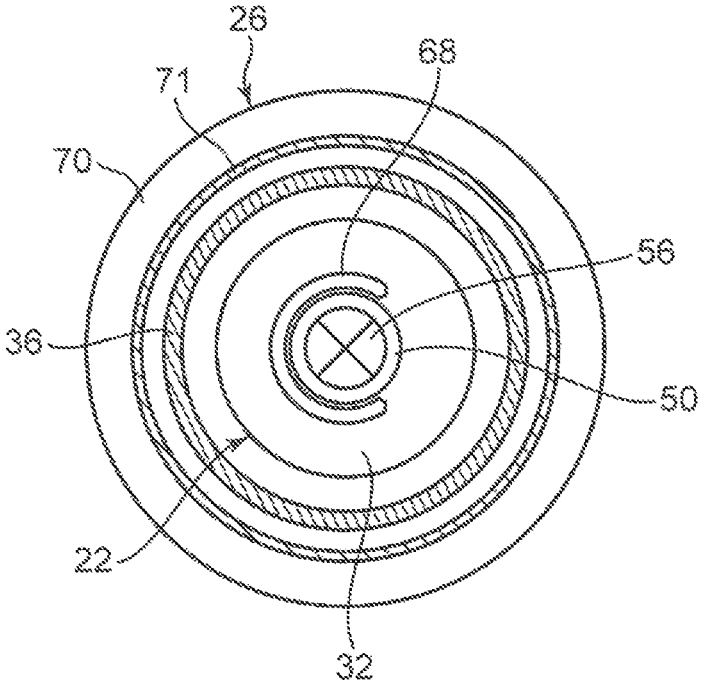
FIG. 6 is a plan view showing a cross section along the line VI-VI in FIG. 3.

As shown in FIGS. 3 and 4, the cooling container 10 includes a container body 18, a pair of first cooling target terminals 21 and a pair of second cooling target terminals 22 arranged corresponding to the pair of superconducting coils 12, respectively.

The container body 18 functions as a vacuum container for containing the pair of superconducting coils 12 and the heat shield container 14 while keeping a vacuum state, and also functions as a support structure to support the pair of refrigerators 16. The container body 18, specifically, includes a main body portion 24 having a shape enclosing the heat shield container 14 to house the heat shield container 14, and a pair of refrigerator support parts 26 that support the pair of refrigerators 16, respectively.

The pair of second cooling target terminals 22 are connected to the pair of superconducting coils 12 heat-transferably through heat-transfer members 28, respectively. The heat-transfer member 28 is a member made of a material having a high thermal conductivity, for example, a copper plate adhered to the surface of the frame so as to interconnect the superconducting coil 12 and the second cooling target terminal 22. FIGS. 3 and 4 show only an end portion of the heat-transfer member 28, the end portion being one to be connected to the second cooling target terminal 22.

As shown in FIGS. 3 and 4, each of the pair of the second cooling target terminals 22 has a second cooling target surface 32 which is an upper surface opened upward. The second cooling target terminal 22, in this embodiment, is disposed at such a height position that the second cooling target surface 32 is located on the same level as or lower than the lower portion of the refrigerator support part 26 and on the upper side of the heat shield container 14 in the container body 18.

Each of the pair of the first cooling target terminals 21 is connected to the upper surface of the heat shield container 14 heat-transferably through a heat-transfer member 34. The heat-transfer member 34 is provided upright on the heat shield container 14, and supports the first cooling target terminal 21 at a predetermined height position raiseably and lowerably. The heat-transfer member 34, specifically, has a cylindrical member 36 and a deformable part 38. The cylindrical member 36 has a cylindrical shape having a vertical center axis, and has an upper end connected to the lower surface of the first cooling target terminal 21 and a lower end opposite thereto. The deformable part 38 has an annular shape interposed between the lower end of the cylindrical member 36 and the upper surface of the heat shield container 14, being deformable so as to allow the cylindrical member 36 and the first cooling target terminal 21 to be raised and lowered. The deformable part 38 includes, for example, a flexible material that can be flexed to allow the raising and lowering.

As shown in FIGS. 3 and 4, each of the pair of the first cooling target terminals 21 is formed of a horizontal plate material, having a first cooling target surface 31 which is an upper surface opened upward. The first cooling target terminal 21 is disposed at a height position where the first cooling target surface 31 is located above the second cooling target surface 32, in other words, at a height position where the second cooling target surface 32 is located below the first cooling target surface 31, in the container body 18, specifically in this embodiment, at a middle position with respect to the height direction of the refrigerator support part 26.

Next will be described the configuration of the pair of refrigerators 16 and the structure for attaching and detaching them with reference to FIGS. 3 to 6. Since the pair of refrigerators 16 and the structures for attaching and detaching the refrigerators are the same as each other, only one of the refrigerators 16 will be described below.

The refrigerator 16 includes a cylinder 40, a displacer 42, and a driving part 44. The cylinder 40 has a substantially cylindrical shape, and houses the displaces 42 so as to allow the displacer 42 to reciprocate along the center axis of the cylinder 40. The driving part 44 drives the displacer 42 so as to reciprocate the displacer 42 in the cylinder 40 to thereby generate cold heat.

The cylinder 40 includes a first cylinder portion 47 and a second cylinder portion 48 which are axially continuous with each other, and, as shown in FIGS. 3 and 4, configured to be attached to the cooling container 10 in a posture where the first cylinder portion 47 is located below the first cylinder portion 47. Hereinafter, this posture is referred to as "attachment posture".

The first cylinder portion 47 has an outer diameter and an inner diameter which are larger than the outer diameter and the inner diameter of the second cylinder portion 48, respectively. The lower end portion out of opposite end portions of the first cylinder portion 47, namely, the upper end portion and the lower end portion in the attachment posture, is continued to the second cylinder portion 48. The upper end portion is opened so as to enclose a displacer insertion port, and receives the displacer 42 inserted into the cylinder 40 through the displacer insertion port. The lower end of the second cylinder portion 48 in the attachment posture is closed by a bottom wall 50.

The displacer 42 has a first displacer portion 51 and a second displacer portion 52 that are axially continued with each other. The first displacer portion 51 constitutes a first-stage cold head 55 in cooperation with the first cylinder portion 47, and reciprocates in the first cylinder portion 47 to thereby generate cold heat to be cooled to a first operation temperature (for example, 40K). Similarly, the second displacer portion 52 constitutes a second-stage cold head 56 in cooperation with the second cylinder portion 48, and reciprocates in the second cylinder portion 48 to thereby generate cold heat to be cooled to a second operation temperature lower than the first operation temperature (for example, 4K).

The driving part 44 is connected to an end portion of the displacer 42, more specifically, an end portion on the opposite side to the second displacer portion 52, out of opposite end portions of the second displacer portion 52, namely the upper end portion in the attachment posture, and axially reciprocates the first and second displacer portions 51, 52 to thereby generate cold heat. The driving part 44 is detachable from the cylinder 40 integrally with the displacer 42 while being kept connected to the displacer 42.

The upper end portion of the first cylinder portion 47 (i.e, the peripheral edge portion of the displacer insertion port) and a portion near the tower end portion in the attachment posture are formed with an upper end flange 58 and a middle flange 60, respectively, each of which projects radially outward beyond the other portions of the first cylinder portion 47. The lower surface of the middle flange 60 serves as a lower surface 62 of the first-stage cold head 55, the lower surface 62 being contactable with the first cooling target surface 31 which is the upper surface of the first cooling target terminal 21. Besides, the lower surface of the bottom wall 50 of the second cylinder portion 48 serves as a lower surface 64 of the second-stage cold head 56 contactable with the second cooling target surface 32 which is the upper surface of the second cooling target terminal 22.

In other words, the refrigerator 16 is attached to the refrigerator support part 26 so as to oppose respective lower surfaces 62 and 64 of the first-stage and second-stage cold heads 55 and 56 vertically to respective first and second cooling surfaces 31 and 32 of the first and second cooling target terminals 21 and 22, respectively. The first cooling target terminal 21 here forms an annular shape enclosing the thus attached refrigerator 16, more specifically, an annular shape defining a through hole 66 allowing the refrigerator 16 to be vertically inserted therethrough.

On the second cooling target surface 32 of the second cooling target terminal 22, a guide member 68 is preferably provided for guiding the lower end of the second-stage cold head 56 of the refrigerator 16 inserted from above to a center normal position. The guide member 68 is substantially annular in plan view (substantially C-shaped in the example shown in FIG. 6), having a conical guide surface whose inner diameter is gradually decreased downwardly (i.e., decreased toward the second cooling target surface 32).

The refrigerator support part 26 of the container body 18 includes a refrigerator support base 70, a support column 71, and a support top wall 72. The refrigerator support base 70 is a portion projecting upward beyond the upper surface of the main body portion 24 of the container body 18, having an annular shape enclosing the refrigerator 16 and the second cooling target terminal 22 in plan view. The support column 71 has a cylindrical shape having an inner diameter allowing the support column 71 to house the refrigerator 16 and the first cooling target terminal 21, being provided upright on the refrigerator support base 70. The support top wall 72 is joined to the upper end of the support column 71 to close the opening enclosed by the upper end of the support column. The support top wall 72 has an annular shape enclosing a through hole 74 that allows the refrigerator 16 to be vertically inserted therethrough at the center of the support top wall 72.

In the refrigerator support part 26, disposed is an oxide superconducting lead 75 as shown in FIG. 3. The oxide superconducting lead 75 is a member that serves as a path for supplying a current from a power source disposed outside the cooling container 10 to the pair of superconducting coils 12, having an electric resistance close to 0 in a cryogenic state. The oxide superconducting lead 75 is preferably disposed in the vicinity of the second-stage cold head 56 of the refrigerator 16, for example, in a posture of vertically extending along the second-stage cold head 56 as shown in FIG. 3. This arrangement enables the oxide superconducting lead 75 to be kept in a sufficiently low temperature state for a while even when an operation failure occurs in the external power supply or the refrigerator 16, thereby allowing the oxide superconducting lead 75 to be prevented from being burned out by a rapid increase in electric resistance due to a rapid temperature rise in the oxide superconducting lead 75.

The cooling container 10 according to this embodiment, as the feature thereof, further includes a means for facilitating the attachment/detachment of the refrigerator 16 to/from the refrigerator support part 26 (more specifically, the below-described attachment/detachment of the displacer 42 and the drive unit 46 of the refrigerator 16 will be described later.) while keeping a vacuum state in the container body 18. Specifically, the means includes a cylinder holder 76, a first raising and lowering mechanism 77, and a second raising and lowering mechanism 78, which are shown in detail in FIGS. 7 to 10.

The cylinder holder 76 holds the cylinder 40 of the refrigerator 16 being in the attachment posture, while being supported by the container body 18, more specifically, by the support top wall 72 of the refrigerator support part 26, so as to be raiseable and lowerable relatively to the container body 18 and integrally with the cylinder 40. The attachment posture is, specifically, a posture where the lower surface 62 of the first-stage cold head 55 (the lower surface of the middle flange 60 in this embodiment) and the lower surface 64 of the second-stage cold head 56 (the lower surface of the bottom wall 50 in this embodiment) are vertically opposed to the first cooling target surface 31 and the second cooling target surface 32, respectively.

Specifically, the cylinder holder 76 integrally includes a body plate 80 and a guided portion 82.

The body plate 80 is a flat plate having an annular shape enclosing a through hole 83 that allows the refrigerator 16 to be vertically inserted therethrough, being disposed on the support top wall 72 in a horizontal posture. The upper surface of the body plate 80 is formed with a recess portion 84 for positioning the refrigerator 16, holding the upper end flange 58 of the cylinder 40 in a state where the upper end flange 58 is fitted into the recess portion 84. In other words, the upper end flange 58 is fixed to the body plate 80 with contact of the lower surface of the upper end flange 58 with the upper surface of the body plate 80. Specific means for the fixing are not limited. The means may be, for example, either a mechanism for clamping the upper end flange 58 between the upper surface of the body plate 80 and a lower surface of a clamp member, or a fastener including a bolt. Alternatively, may be performed suction of the upper end flange 58 by a magnetic force which has no effect on the operation of the refrigerator 16.

Figure 7:
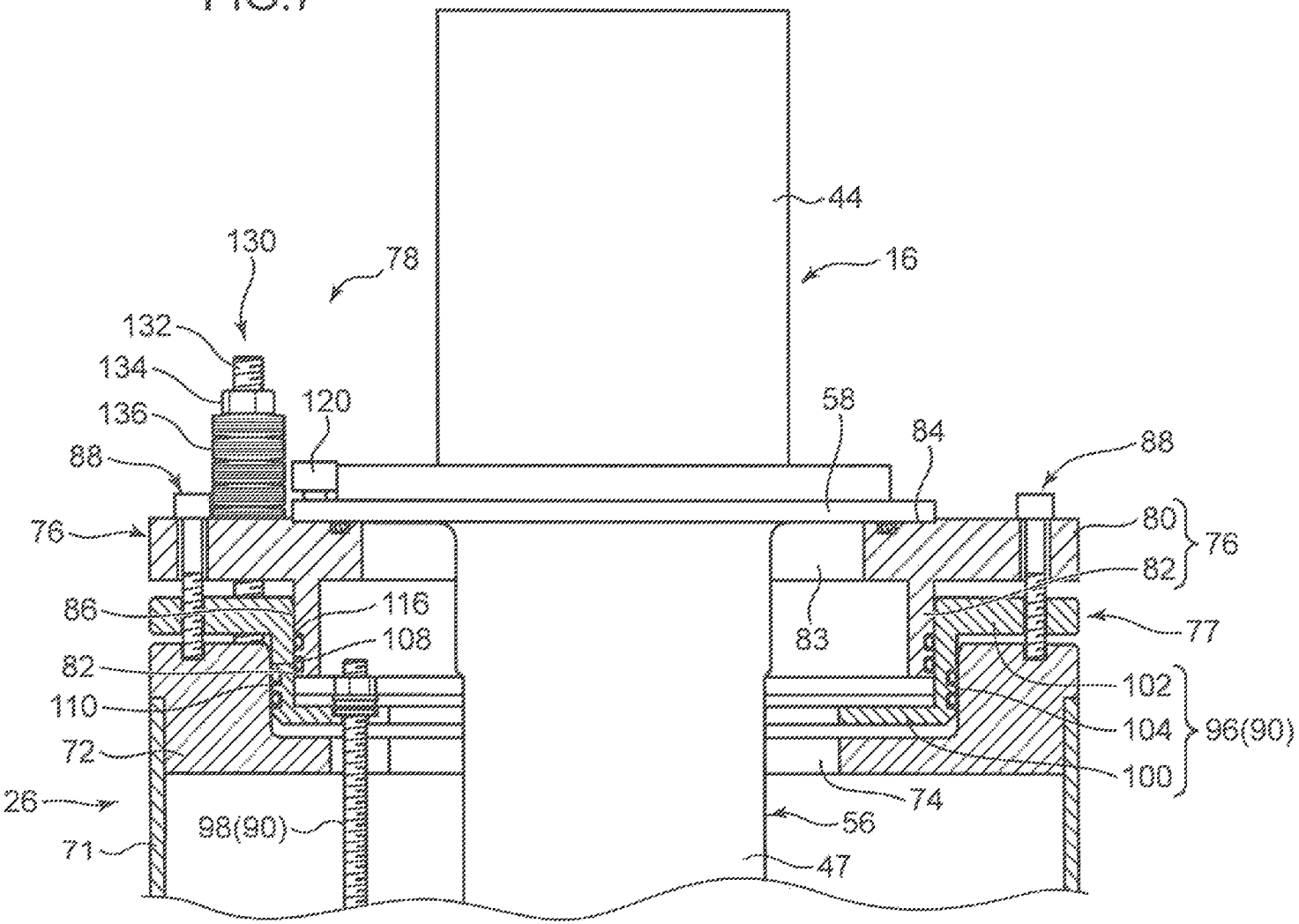
FIG. 7 is an enlarged cross-sectional front view showing an upper portion of the refrigerator support part shown in FIG. 3, and a cylinder holder and an upper portion of the refrigerator which are supported by the refrigerator support part.
Figure 9:
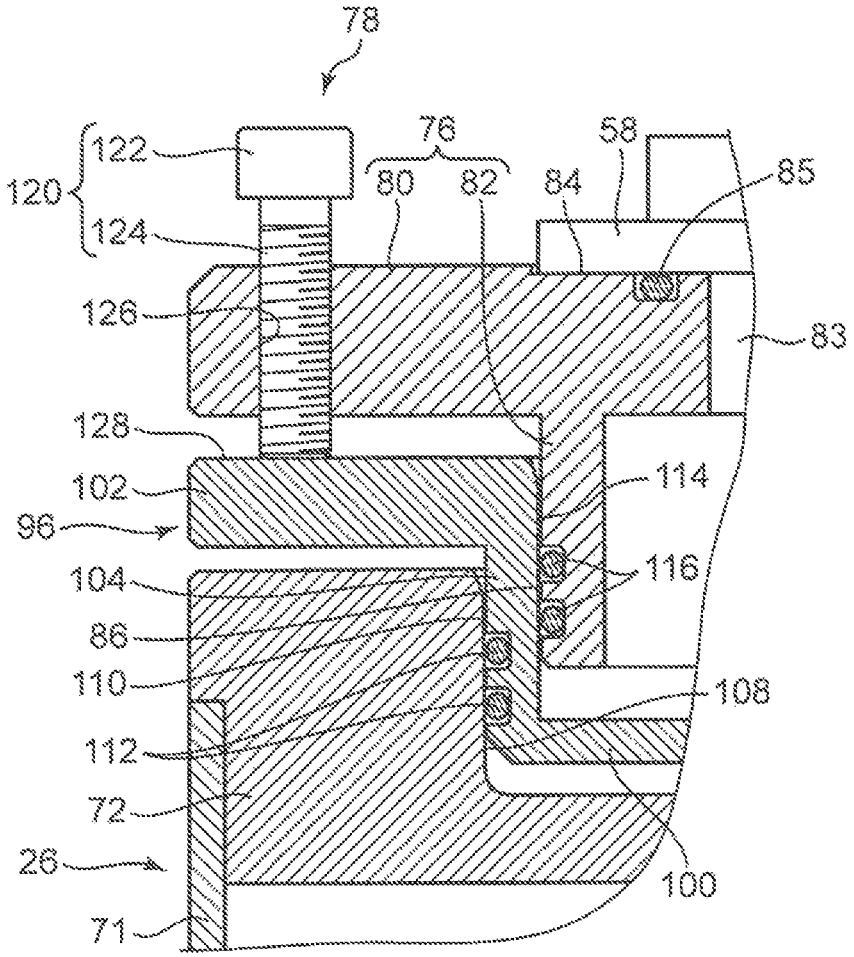
FIG. 9 is an enlarged vertical sectional view showing a second screw member and the peripheral region thereof in the cryogenic apparatus.
Figure 10:
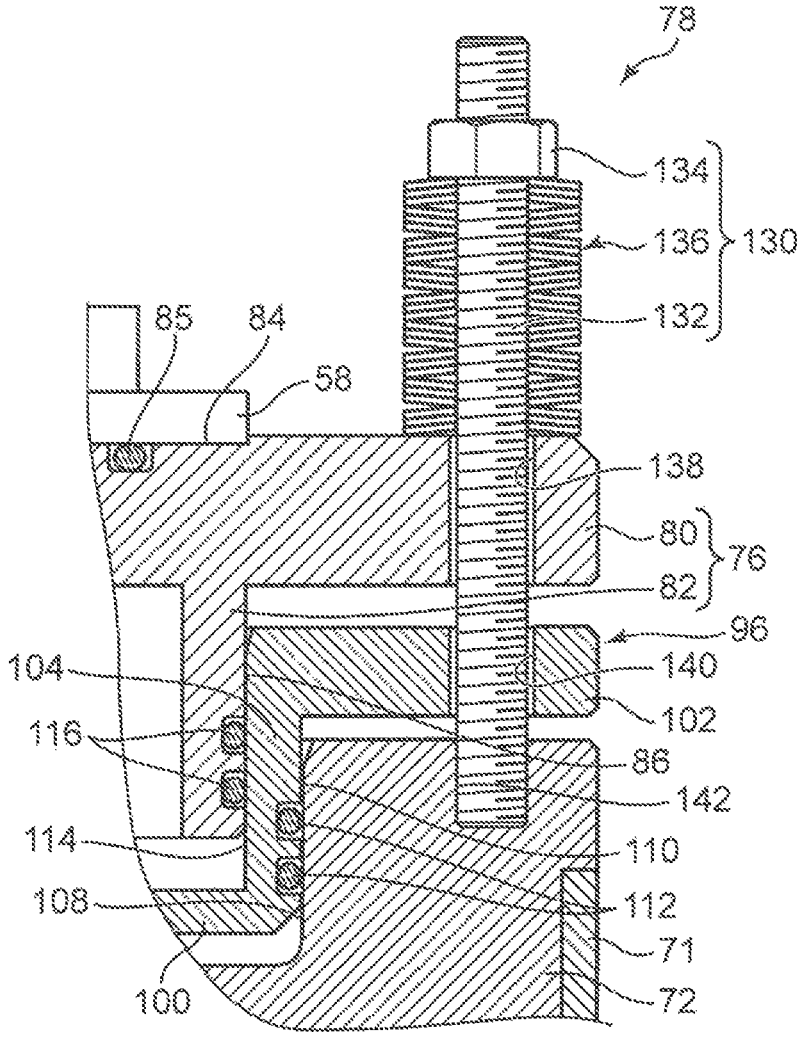
FIG. 10 is an enlarged vertical sectional view showing a biasing mechanism and the peripheral portion thereof in the cryogenic apparatus.

Between the lower surface of the upper end flange 58 and the upper surface of the body plate 80, preferably, an annular cylinder seal member 85 as shown in FIGS. 7, 9 and 10 is interposed over the entire circumference. The cylinder seal member 85 is, for example, a rubber O-ring fitted into a circumferential groove formed in the upper surface of the body plate 80.

The guided portion 82 has a cylindrical shape enclosing the refrigerator 16, being joined to the body plate 80 so as to extend downward from the lower surface of the body plate 80 at a position coaxial with the through hole 83. As will be described in detail later, the outer peripheral surface of the guided portion 82 forms a cylindrical second guided surface 86 to be vertically guided.

The second raising and lowering mechanism 78 is connected to the cylinder holder 76 to raise and lower the cylinder holder 76 between the second heat-transfer position and the second cut-off position. The second heat-transfer position is a height position at which the lower surface 64 of the second-stage cold head 56 (the lower surface of the bottom wall 50) comes in contact with the second cooling object surface 32 to allow heat-transfer between the second-stage cold head 56 and the second cooling target terminal 22. The second cut-off position is a height position at which the lower surface 64 of the second-stage cold head 56 is separated upward from the second cold surface 32 to cut off the heat-transfer between the second-stage cold head 56 and the second cooling target terminal 22. The specific configuration of the second raising and lowering mechanism 78 will be described later.

The first raising and lowering mechanism 77 is connected to the first cooling target terminal 21 to raise and lower the first cooling target terminal 21 between the first heat-transfer position and the first cut-off position. The first heat-transfer position is a height position at which the first cooling target surface 31 comes in contact with the lower surface 62 of the first-stage cold head 55 being at a height position corresponding to the second heat-transfer position to allow heat-transfer between the first-stage cold head 55 and the first cooling target terminal 21. The first cut-off position is a height position at which the first cooling target surface 31 is separated downward from the lower surface 62 of the first-stage cold head 55 to cut off the heat-transfer between the first-stage cold head 55 and the first cooling target terminal 21.

The first raising and lowering mechanism 77 according to this embodiment includes a feed screw mechanism. The feed screw mechanism is configured to raise and lower the first cooling target terminal 21 in response to a rotational operation applied to the feed screw mechanism. Specifically, the first raising and lowering mechanism 77 includes a plurality of first bolts (first screw members) 88 and a first raised and lowered body 90.

The plurality of first bolts 88 are provided at a plurality of positions aligned circumferentially on the cylinder holder 76, respectively, and have the same shape. FIG. 7 shows two first bolts 88 out of the plurality of first bolts 88.

Figure 8:
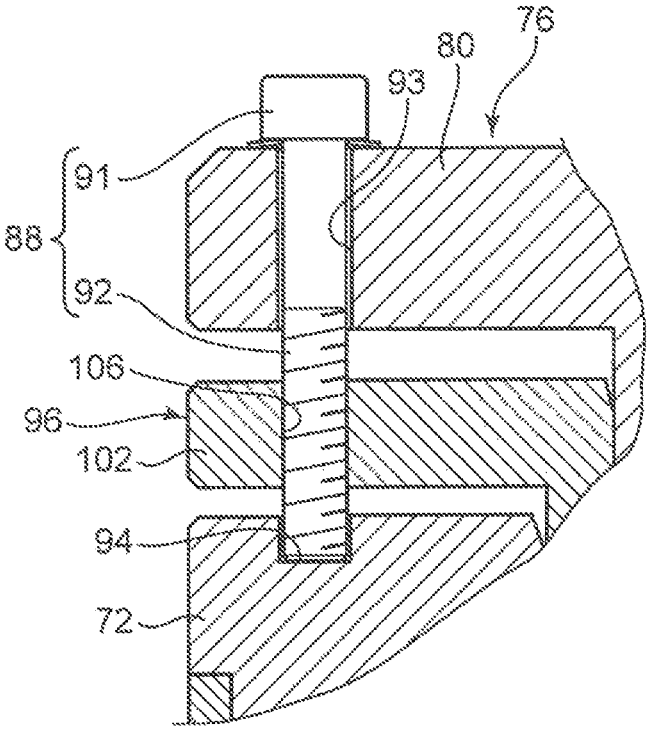
FIG. 8 is an enlarged vertical sectional view showing a first screw member and the peripheral region thereof in the cryogenic apparatus.

As shown in FIG. 8, each of the plurality of first bolts 88 includes a head portion 91 and a first screw portion 92. The head portion 91 serves as a first operation portion allowing a rotational operation around the center axis of the first bolt 88 to be applied thereto. The first screw portion 92 is a shaft having a cylindrical outer peripheral surface with a smaller diameter than that of the head portion 91, and the outer peripheral surface is formed with a spiral male screw that vertically advances along with the rotational operation.

The first bolt 88 is supported on the container body 18, specifically, the support top wall 72 of the refrigerator support part 26, rotatably about a vertical axis. Specifically, in the posture where the first screw portion 92 extends vertically and the head portion 91 is located above the body plate 80 of the cylinder holder 76, the lower end of the first screw portion 92 is supported by the support top wall 72 rotatably about the center axis of the first screw portion 92. More specifically, the body plate 80 of the cylinder holder 76 is formed with a bolt insertion hole 93 penetrating the body plate 80 vertically so as to allow the first screw portion 92 to be vertically inserted therethrough. On the other hand, the upper surface of the support top wall 77 is formed with a recessed portion 94 partially recessed downward, and the lower end portion of the first screw portion 92 is rotatably fitted into the recessed portion 94 with little gap.

The first raised and lowered body 90 is connected to the first cooling target terminal 21 so as to be raiseable and lowerable together with the first cooling target terminal 21, and is supported by the container body 18, specifically, the support top wall 72 of the refrigerator support part 26 so as to be raiseable and lowerable. The first raised and lowered body 90 includes a portion that is screw-engagable with the first screw portion 92 of the first bolt 88, thereby being raiseable and lowerable along with the rotational operation applied to the head portion 91 of the first bolt 88.

Specifically, the first raised and lowered body 90 includes an raised and lowered flange 96 and a plurality of connection rods 98. The raised and lowered flange 96, which serves as a screw-engagememt member that is screw-engaged with the first screw portion 92, is disposed between the upper surface of the support top wall 72 and the cylinder holder 76, so as to be raiseable and lowerable. The plurality of connection rods 98 serve as connection members that vertically interconnect the raised and lowered flange 96 and the first cooling target terminal 21 so as to cause them to be integrally raised and lowered.

The raised and lowered flange 96 includes a center plate portion 100, a flange portion 102, and a guided peripheral wall 104, which are integrated with each other. The center plate portion 100 is an annular flat plate enclosing the refrigerator 16. The center plate portion 100, specifically, is formed with a through hole 101 allowing the refrigerator 16 to be inserted therethrough, at the center of the center plate portion 100. The flange portion 102 is an annular flat plate located radially outward of the center plate portion 100 in plan view, being located above the center plate portion 100. In summary, a vertical step is provided between the center plate portion 100 and the flange portion 102. The guided peripheral wall 104 has a cylindrical shape having a vertical center axis, being integrally connected to the center plate portion 100 and the flange portion 102 so as to vertically interconnect the outer peripheral portion of the center plate portion 100 and the inner peripheral portion of the flange portion 102.

The flange portion 102 is formed with a plurality of screw holes 106 penetrating the flange portion 102 vertically. The plurality of screw holes 106 are provided for the plurality of first bolts 88, respectively. The flange portion 102 has a plurality of inner peripheral surfaces that enclose the plurality of screw holes 106, respectively, and each of the inner peripheral surfaces is formed with a female screw to be screw-engaged with the male screw of the first screw portion 92 of the first bolt 88. The plurality of first bolts 88, therefore, can be screw-engaged with the flange portion 102 in a state of being inserted into the respective screw holes 106.

As also shown in FIGS. 9 and 10, the guided peripheral wall 104 serves as a guided portion which is guided vertically by the support top wall 72. Specifically, the radially inner portion of the support top wall 72 is recessed downward with respect to the outer peripheral portion outside thereof, and a first guide surface 108 is formed at the boundary between the radially inner portion and the outer peripheral portion, the first guide surface 108 being a cylindrical inner peripheral surface facing radially inward. On the other hand, the guided peripheral wall 104 has a cylindrical outer peripheral surface which is fitted with the first guide surface 108 with a slight gap, the outer peripheral surface forming a first guided surface 110 which is vertically guided by the first guide surface 108.

As shown in FIGS. 9 and 10, a plurality of annular first seal members 112 are interposed between the first guide surface 108 and the first guided surface 110 over the entire circumference thereof. The plurality of the first seal members 112 are, for example, rubber O-rings fitted into circumferential grooves formed in the first guided surface 110. The plurality of first seal members 112 constitute a screw member seal part that hermetically seals the refrigerator support part 26 and, furthermore, the container body 18, while allowing the raised and lowered flange 96 to be raised and lowered relatively to the support top wall 72.

The guided peripheral wall 104 functions not only as a guided portion to be guided by the support top wall 72 but also as a guide portion to guide the cylinder holder 76 vertically. Specifically, the inner peripheral surface of the guided peripheral wall 104 forms a cylindrical second guide surface 114 extending vertically at a position radially inward of the first guided surface 110, being fitted with the outer peripheral surface of the guided portion 82 of the cylinder holder 76, namely, the second guided surface 86, with a slight gap, thereby guiding the guided portion 82 vertically.

Between the second guide surface 114 and the second guided surface 86, interposed are a plurality of annular second seal members 116 over the entire circumference thereof. The plurality of second seal members 116 are, for example, rubber O-rings fitted into circumferential grooves formed in the second guided surface 86. The plurality of second seal members 116 constitute a holder seal part interposed between the support top wall 72 and the cylinder holder 76 (in this embodiment, brought into contact with the second guide surface 114) so as to allow the cylinder holder 76 to be raised and lowered relatively to the support top wall 72 while hermetically sealing the inside of the refrigerator support part 26.

The second guide surface of the "guided part" according to the present invention may be located radially outward of the first guided surface. For example, it is also possible that the inner peripheral surface of the raised and lowered flange 96 shown in FIGS. 9 and 10 forms the first guided surface, and the outer peripheral surface forms the second guided surface. In this case, the first guide surface of the support top wall 72 is a cylindrical outer peripheral surface radially opposed to the first guided surface, and the second guided surface of the cylinder holder 76 is a cylindrical inner peripheral surface radially opposed to the second guide surface.

The plurality of connection rods 98 are provided at a plurality of positions aligned circumferentially, and FIGS. 3 and 7 show one of the connection rods 98. Each of the connection rods 98 is disposed in a posture of vertically extending, having an upper end portion connected to the center plate portion 100 of the raised and lowered flange 96 and a lower end portion connected to the first cooling target terminal 21.

The second raising and lowering mechanism 78 includes a feed screw mechanism that converts a rotational operation applied to the feed screw mechanism into the raised or lowered motion of the cylinder holder 76. The second raising and lowering mechanism 78, specifically, includes a plurality of second bolts (second screw members) 120. The plurality of second bolts 120 are provided at a plurality of positions aligned circumferentially of the body plate 80 of the cylinder holder 76, respectively, and FIGS. 3 and 7 show one of the second bolts 120.

Each of the plurality of the second bolts 120 has a head portion 122 and a second screw portion 124 as shown in FIG. 9. The head portion 122 serves as a second operation portion allowing a rotational operation around the center axis of the second bolt 120 to be applied to the head portion 122. The second screw portion 124 is a shaft having a cylindrical outer peripheral surface which has a smaller diameter than that of the head portion 122, the outer peripheral surface being formed with a male screw that advances vertically along with the rotational operation.

The second bolt 120 is screw-engaged with the body plate in a state where the head portion 122 is located above the cylinder holder 76 and the second screw portion. 124 extends downward from the head portion 122 to penetrate the body plate 80 of the cylinder holder 76 vertically. Specifically, the body plate 80 is formed with screw holes 126 penetrating the body plate 80 at a plurality of positions aligned circumferentially, respectively, and the inner peripheral surface of the body plate 80 defining the screw holes 126 is formed with a female screw that is screw-engagable with the male screw of the second screw portion 124. Each of the plurality of second bolts 120 can be screw-engaged with the body plate 80 in a state that the second screw portion 124 is inserted into the screw hole 126 corresponding to the second bolt 120.

The body plate 80 is located immediately above the flange portion 102 of the raised and lowered flange 96. Accordingly, the abutment of the lower end of the second screw portion 124 of the second bolt 120 on the upper surface 128 of the flange portion 102 restrains the second bolt 120 from further downward displacement beyond the abutment position. This allows the cylinder holder 76 to be raised relatively to the support top wall 72 and the raised and lowered flange 96 along with a rotational operation in a specific direction applied to the head portion 122 of the second bolt 120. The restraint of the second bolt 120 from the downward displacement is not limited to the mode shown in FIG. 9 but also permitted to be achieved, for example, in a mode where the second screw portion 124 further penetrates the flange portion 102 to allow the lower end of the second screw portion 124 to abut the upper surface of the support top wall 72.

The second raising and lowering mechanism 78 further includes a plurality of biasing mechanisms 130. Each of the plurality of biasing mechanisms 130 applies a downward biasing force to the cylinder holder 76 to further ensure contact of the lower surface 64 of the second-stage cold head 56 of the refrigerator 16 including the cylinder 40 held by the cylinder holder 76 with the second cooling target surface 32. The plurality of biasing mechanisms 130 are provided at a plurality of positions aligned circumferentially in the cylinder holder 76, respectively, and FIGS. 3, 4, and 7 show only one biasing mechanism 130 of the plurality of biasing mechanisms 130.

As shown in FIG. 10, each of the plurality of biasing mechanisms 130 includes a screw shaft 132, a nut 134, and a spring member 136.

The screw shaft 132 is fixed to the support top wall 72, while being penetrating the cylinder holder 76 so as to allow the cylinder holder 76 to be raised and lowered, and has a male screw portion at least in a region on an upper side of the cylinder holder 76. The screw shaft 132 according to this embodiment is an stud bolt having an outer peripheral surface formed with a male screw over the entire length of the screw shaft 132. On the other hand, the main body plate 80 of the cylinder holder 76 and the flange portion 102 of the raised and lowered flange 96 are formed with respective screw insertion holes 138 and 140 vertically penetrating the main body plate 80 and the flange portion 102, respectively, and the support top wall 72 is formed with screw holes 142 that are opened upward. The screw shafts 132 are inserted into the screw insertion holes 138 and 140, respectively, and the lower ends of the screw shafts 132 are screw-engaged into the screw holes 142. Each of the screw shaft 132 is thereby fixed to the support top wall 72 in a state of standing up on the support top wall 72.

The nut 134 is screw-engaged to the screw shaft 132 at a position above the body plate 80. The spring member 136 is interposed between the lower surface of the nut 134 and the upper surface of the body plate 80 while being elastically compression-deformed, thereby generating an elastic force acting on the cylinder holder 76 as a downward biasing force. According to the example shown n FIG. 10, the spring member 136 is composed of a plurality of coned disc springs stacked vertically. The spring member 136, however, may be a compression coil spring or a block body largely deformable in the compression direction.

The nut 134, vertically moved relatively to the screw shaft 132 by a rotational operation applied thereto, can change the elastic force of the spring member 136 interposed between the lower surface of the nut 134 and the upper surface of the body plate 80, that is, the downward biasing force acting on the cylinder holder 76.

The cooling container 10 described above can be easily switched between a state of allowing respective heat-transfers between the first-stage and second-stage cold heads 55 and 56 of the refrigerator 16 and the first and second cooling target terminals 21 and 22 and a state of cutting off the heat-transfers, with a simple operation of raising and lowering the cylinder holder 76 and the first cooling target terminal 21 relatively to the container body 18 (in this embodiment, the refrigerator supports 26 of the container body 18) by use of the first and second raising and lowering mechanisms 77 and 78, respectively, without interposing any special member such as a sleeve between the refrigerator 16 and the cooling objects (in this embodiment, a pair of superconducting coils 12 and a heat shield container 14). This makes it possible to efficiently cool the cooling object by the refrigerator 16 and to easily perform maintenance of the refrigerator 16.

The cooling container 10, specifically, enables attachment/detachment of the refrigerator 16 to/from the container body 18 (to be precise, attachment and detachment of the displacer 42 and the drive unit 44 in the refrigerator 16) and maintenance therewith to be performed, for example, in the following manner.

(1) Attachment of the Refrigerator 16 to the Container Body 18

In advance of the use of the cryogenic apparatus, the entire refrigerator 16 is attached to the container body 18. First, the refrigerator 16 is inserted into a refrigerator support part 26 from above in the attachment posture where the second-stage cold head 56 of the refrigerator 16 is located below the first-stage cold head 55. More specifically, the refrigerator 16 is inserted into the through holes 83, 101 and 74 formed in the main body plate 80 of the cylinder holder 76, the center plate portion 100 of the raised and lowered flange 96, and the support top wall 72, respectively, from above and the upper end flange 58 of the cylinder 40 in the refrigerator 16 is fitted into the recess portion 84 of the main body plate 80. In short, the insertion of the refrigerator 16 is advanced to a position where the lower surface of the upper end flange 58 abuts the upper surface of the main body plate 80 (the bottom surface of the recess portion 84).

In this initial stage, it is preferable that respective height positions of the cylinder holder 76 and the first cooling target terminal 21 are adjusted in advance by the first and second raising and lowering mechanisms 77 and 78 so as to separate the lower surfaces 62 and 64 of the first and second-stage cold heads 55 and 56 upward from the first and second cooling target surfaces 31 and 32 of the first and second cooling target terminals 21 and 12, that is, so as to prevent the lower surfaces 62 and 64 from reaching the first and second cooling target surfaces 31 and 32, respectively, at the stage of completion of the insertion of the refrigerator 16. Specifically, it is preferable that the height position of the cylinder holder 76 is set to a sufficiently high position while the height position of the first cooling target terminal 21 is set to a sufficiently low position.

Following the completion of the insertion of the refrigerator 16, the upper end flange 58 of the cylinder 40 is fixed to the body plate 80 of the cylinder holder 76 by appropriate means. Specifically, in a state where the upper end flange 58 is fitted into the recess portion 84 of the body plate 80, while the cylinder seal member 85 is interposed between the bottom surface of the recess portion 84 and the lower surface of the upper end flange 58, the upper end flange 58 is fixed to the body plate 80. This enables the cylinder holder 76 and the entire refrigerator 16 including the cylinder 40 to be integrally raised and lowered.

After the fixing, the cylinder holder 76 is lowered by the operation of the second raising and lowering mechanism 78 to thereby bring the lower surface 64 of the second-stage cold head 56 into contact with the second cooling target surface 32 of the second cooling target terminal 22 and adjust the contact pressure thereof. Specifically, a rotational operation is applied to the head portion 122 of the second bolt 120 shown in FIG. 9 in a predetermined direction to raise the bolt 120 relatively to the body plate 80. This causes the cylinder holder 76 including the body plate 80 and the refrigerator 16 fixed thereto to be gradually lowered by their self weights and the biasing force applied by the biasing mechanism 130 to reach the second heat-transfer transfer position, where the lower surface 64 of the second-stage cold head 56 and the second cooling target surface 32 of the second cooling target terminal 22 come into contact with each other. The preferred operation of each of the second bolts 120 to be performed at this stage will be described in detail later in the section "(3) Reattachment of the displacer 42 and the drive unit 44".

After reaching the second heat-transfer position, through further rotational operation applied to the nut 134 of the biasing mechanism 130 shown in FIG. 10 in the direction for lowering the nut 134, the downward biasing force, which is the elastic force of the spring member 136 of the biasing mechanism 130, is increased, whereby the contact pressure of the lower surface 64 of the second-stage cold head 56 with the second cooling target surface 32 is increased. When the contact pressure reaches an appropriate contact pressure, the rotational operation to the nut 134 is stopped. The adjustment of the contact pressure is thus achieved.

Following the completion of the adjustment of the contact pressure between the lower surface 64 of the second-stage cold head 56 and the second cooling target surface 32, the first raising and lowering mechanism 77 is operated to bring the first cooling target surface 31 of the first cooling target terminal 21 into contact with the lower surface 62 of the first-stage cold head 55 and adjust the contact pressure thereof. Specifically, a rotational operation is applied to the head portion 91 of the first bolt 88 in the direction for raising the flange portion 102 of the raised and lowered flange 96 relatively to the first bolt 88 shown in FIG. 8. This causes the raised and lowered flange 96 and the first cooling target terminal 21 connected thereto through the plurality of connection rods 98 are integrally raised relatively to the container body 18 including the refrigerator support part 26, and the first cooling target terminal 21 reaches the first heat-transfer position, where the first cooling target surface 31 of the first cooling target terminal 21 comes in contact with the lower surface 62 of the first-stage cold head 55. With further rotational operation of the first bolt 88, the contact pressure between the first cooling target surface 31 and the lower surface 62 of the first-stage cold head 55 are increased. When the increased contact pressure reaches an appropriate contact pressure, the rotational operation of the first bolt 88 is stopped. The adjustment of the contact pressure is thus achieved, and the attachment of the refrigerator 16 is completed.

In the state of completion of the attachment, respective lower surfaces 62 and 64 of the first-stage and second-stage cold heads 55 and 56 of the refrigerator 16 are in contact with the first and second cooling target surfaces 31 and 32 with sufficient contact pressure, which allows respective excellent heat-transfers between the first and second-stage cold heads 55 and 56 and the first and second cooling target terminals 21 and 22. This allows the first and second cooling target terminals 21 and 22 and the first and second cooling objects (in this embodiment, the heat shield container 14 and the pair of superconducting coils 12) connected thereto to be cooled well to predetermined respective target temperatures by the operation of the refrigerator 16.

(2) Detachment of the Displacer 42 and the Drive Unit 44 of the Refrigerator 16 from the Container Body 18

At the point in time when maintenance becomes required for the displacer 42 or the driving part 44 of the refrigerator 16, the displaces 42 and the driving part 44 are detached from the container body 18. The displacer 42 and the driving part 44 are extracted from the cylinder 40 of the refrigerator 16 while the cylinder 40 is kept held by the cylinder holder 76. Furthermore, this operation can be performed in a state of cutting off the heat-transfer between the cylinder 40 and the first and second cooling target terminals 21 and 22 by operation of the first and second raising and lowering mechanisms 77 and 78. The details are as follows.

First, a rotational operation is applied to the head portion 91 of the first bolt 88 of the first raising and lowering mechanism 77 in a direction for lowering the flange portion 102 relatively to the first bolt 88. This rotational operation causes the raised and lowered flange 96 including the flange portion 102, the plurality of connection rods 98, and the first cooling target terminal 21 to be integrally lowered. The first cooling target surface 31 of the first cooling target terminal 21 is thereby separated downward from the lower surface 62 of the first-stage cold head 55 of the refrigerator 16 to cut off the heat-transfer between the first-stage cold head 55 and the first cooling target terminal 21.

Next, a rotational operation is applied to the head portion 122 of the second bolt 120 of the second raising and lowering mechanism 78, in a direction for raising the body plate 80 of the cylinder holder 76 relatively to the second bolt 120. At this time, the abutment of the lower end of the second screw portion 124 of the second bolt 120 on the upper surface 128 of the flange portion 102 restrains the second bolt 120 from downward displacement, which causes the entire refrigerator 16 including the cylinder holder 76 and the cylinder 40 held therein to be raised against their self weights and the biasing force applied by the biasing mechanism 130 (the elastic force caused by the spring member 136). The lower surface 64 of the second-stage cold head 56 of the refrigerator 16 is thereby separated upward from the second-cooling target surface 32 of the second cooling target terminal 22 to cut off the heat-transfer between the second-stage cold head 56 and the second cooling target terminal 22.

It is not required to newly operate the biasing mechanism 13 before the rotationaly operation of the second bolt 120. No operation to leave the biasing mechanism 130 as it is eliminates the need for re-adjusting the biasing force upon the below-described re-attachement of the displacer 42 and the drive unit 44. It may be, conversely, performed to raise the nut 134 of the biasing mechanism 130 prior to the rotational operation of the second bolt 120 to reduce the operation force rewired for the rotational operation.

Following the completion of the operation of the first and second raising and lowering mechanisms 77 and 78, the connection is released between the cylinder 40 and the displacer 42 in the refrigerator 16, and the displacer 42 and the driving part 44 connected thereto are pulled out upward from the cylinder 40 which is still being held by the cylinder holder 76.

At this time, respective heat-transfers between the first-stage and second-stage cold heads 55 and 56 and the first and second cooling target terminals 21 and 22 has been cut off through the operations of the first and second-stage raising and lowering mechanisms 77 and 78, respectively, which reduces ice or frost on the inner side face caused by exposure of the inner side face of the cylinder 40 to the atmosphere involved by extraction of the displacer 42. Even if ice or frost adheres to the inner surface of the cylinder 40, it is easy to remove the ice or frost by heating the inner surface because heat intrusion from the cylinder 40 to the first and second cooling target terminals 21 and 22 is reduced by the cut-off of the heat-transfer.

The heating of the inner surface of the cylinder 40 may be carried out, for example, by either blowed hot air or an operated heater (for example, an electric heating wire routed on the inner side surface) previously placed on the inner surface. In the latter case, operating the heater before extracting the displacer 42 from the cylinder 40 can prevent icing and frosting.

The displacer 42 and the drive unit 44 extracted as described above can be easily subjected to maintenance. The "maintenance" as used herein includes repair, inspection, replacement, and the like of the displacer 42 or the drive unit 44.

(3) Re-Attachment of the Displacer 42 and the Drive Unit 44

After the completion of the maintenance, the displacer 42 is inserted into the cylinder 40 from above, whereby the displacer 42 and the drive unit 44 connected thereto are re-attached to the cooling container 10.

Following the completion of the insertion and assembling of the displacer 42, a rotational operation is applied to the head portion 122 of the second bolt 120 in the direction for lowering the body plate 80 of the cylinder holder 76 relatively to the second bolt 120, which cause the cylinder holder 76 and the refrigerator 16 including the cylinder 40 held by the cylinder holder 76 to be gradually lowered by their self weights. This enables the cylinder holder 76 and the cylinder 40 held by the cylinder holder 76 to reach the second contact position where, the lower surface 64 of the second-stage cold head 56 of the refrigerator 16 including the cylinder 40 comes in contact with the second cooling target surface 32 of the second cooling target terminal 22.

The order of operations of the plurality of second bolts 120 at this time is not limited. Preferably performed are stopping the rotational operation of a part of the plurality of second bolts 120 before the lower end of the second screw portion 124 thereof is separated from the upper surface 128 of the flange portion 102, applying the rotational operation to the other second bolts 120 until the lower end of the second screw portion 124 thereof is separated from the upper surface 128, and thereafter re-applying the rotational operation to the above part of the second bolts 120 simultaneously. These operations can prevent a large load from biasedly acting on a part of the plurality of the second bolts 120. The operations are the same as the first mounting described in the "(1) Attachment of the refrigerator 16 on the container body 18" section.

After the completion of the operations of the second bolts 120, the first bolt 88 of the first raising and lowering mechanism 77 is operated to raise the first raised and lowered body 90 including the raised and lowered flange 96 and the first cooling target terminal 21, thereby allowing the first cooling target surface 31 of the first cooling target terminal 21 to reach the first heat-transfer position for contact with the lower surface fit of the first-stage cold head 55.

During the series of operations described above, the first seal member 112 constituting the holder seal part can keep the container body 18 hermetically sealed regardless of raising or lowering the raised and lowered flange 96 relatively to the support top wall 72, and the second seal member 116 constituting the screw-engaged member seal part can keep the container body 18 hermetically sealed regardless of raising or lowering the cylinder holder 76 relatively to the raised and lowered flange 96 and the support top wall 72. This enables the refrigerator 16 to be easily attached and detached while keeping the vacuum state in the container body 18.

The present invention is not limited to the above-described embodiments. The present invention may include, for example, the following modes.

(A) Support of the Refrigerator by the Container Body

Although the refrigerator support part 26 of the container body 18, in the above embodiment, protrudes upward largely beyond the upper surface of the main body portion 24 to house most of the refrigerator 16 as shown in FIGS. 3 and 4, the portion where the container body supports the refrigerator in the present invention does not necessarily protrude upward beyond the other portions. Meanwhile, the refrigerator support part 26 that partially protrudes upward to house the refrigerator 16 as described above allows wasteful volume of the entire container body 18 to be significantly reduced.

(B) First and Second Raising and Lowering Mechanisms

Each of the first raising and lowering mechanism and the second raising and lowering mechanism according to the present invention may be a linear drive mechanism such as a hydraulic cylinder device or an electromagnetic solenoid device. Meanwhile, the feed screw mechanism as described above allows the contact pressure of the lower surface of the second-stage cold head with the cooling target surface and the contact of the first cooling target surface with the lower surface of the first-stage cold head to be adjusted through rotational operation of the screw member.

The first raising and lowering mechanism according to the present invention is not limited to one including a combination of a screw-engagememt member (the raised and lowered flange 96 in the above embodiment) and a connection member (the plurality of connection rods 98 in the above embodiment). The first raising and lowering mechanism according to the present invention, for example, may include a long first screw member screw-engaged with the container body so as to be raiseable and lowerable and directly connected to the first cooling target terminal. Meanwhile, the combination of the screw-engagement member and the connection member enables the first screw member (in the above embodiment, the first bolt 88) to be disposed on the upper side of the container body to thereby allow the required length of the first screw member to be greatly reduced. Besides, the screw-engagememt member can be compactly arranged by effective utilization, of the space between the container body and the cylinder holder (in the above embodiment, the space between the upper surface of the support top wall 72 and the lower surface of the body plate 80), and allows the screw-engaged member seal part to keep the vacuum state in the container body regardless of the rise and fall of the screw-engagement member. The first screw member is not limited to one penetrating the cylinder holder. The first screw member may be disposed at a radially outer position of the cylinder holder to thereby expose the first operation portion of the first screw member above the container body.

The present invention also encompasses a mode in which the second raising and lowering mechanism does not includes the biasing mechanism 130. In this mode, the lower surface of the second-stage cold head is brought into contact with the cooling target surface by use of only the self-weight of the refrigerator and the like. The biasing mechanism 130, meanwhile, can enhance the reliability of the contact by applying downward biasing force to the cylinder holder 76. Furthermore, adjusting the biasing force of the biasing mechanism 130 allows the contact pressure between the lower surface of the second-stage cold head and the second cooling target surface to be more easily adjusted.

As described above, there is provided a cooling container for containing an cooling object and supporting a refrigerator to allow the cooling object to be efficiently cooled by the refrigerator and to allow the maintenance of the refrigerator to be easily performed.

Provided is a cooling container that contains a first cooling object and a second cooling object for which a target cooling temperature lower than that of the first cooling object is set, the cooling container configured to support a refrigerator including a cylinder, a displacer inserted into the cylinder reciprocably and detachably from the cylinder, and a drive unit that reciprocates the displacer to generate cold heat, the displacer and the cylinder constituting a first-stage cold head having a first operation temperature and a second-stage cold head having a second operation temperature lower than the first operation temperature and aligned axially with the first-stage cold head, to allow the first cooling object and the second cooling object to be cooled by the first-stage cold head and the second-stage cold head, respectively. The cooling container includes: a container body that contains the first cooling object and the second cooling object while keeping a vacuum state; a first cooling target terminal that is disposed in the container body while being heat-transferably connected to the first cooling object, the first cooling target terminal having a first cooling target surface that is opened upward; a second cooling target terminal that is disposed in the container body while being heat-transferably connected to the second object and being raiseable and lowerable, the second cooling target terminal having a second cooling target surface that is opened upward at a position below the first cooling target surface; a cylinder holder supported by the container body so as to be raiseable and lowerable with the cylinder while holding the cylinder in a posture where a lower surface of the first-stage cold head and a lower surface of the second-stage cold head are vertically opposed to the first cooling target surface and the second cooling target surface, respectively; a holder seal part interposed between the container body and the cylinder holder to hermetically seal the container body while allowing the cylinder holder to be raised and lowered relatively to the container body; a second raising and lowering mechanism connected to the cylinder holder to raise and lower the cylinder holder between a second heat-transfer position where the lower surface of the second-stage cold head comes in contact with the second cooling target surface to allow heat-transfer between the second-stage cold head and the second cooling target terminal and a second cut-off position where the lower surface of the second-stage cold head is separated upward from the second cooling target surface to cut off the heat-transfer between the second-stage cold head and the second cooling target terminal; and a first raising and lowering mechanism connected to the first cooling target terminal to raise and lower the first cooling target terminal between a first heat-transfer position where the first cooling target surface comes in contact with the lower surface of the first-stage cold head which is located at a height position corresponding to the second heat-transfer position to allow heat-transfer between the first-stage cold head and the first cooling target terminal and a first cut-off position where the first cooling target surface is separated downward from the lower surface of the first-stage cold head to cut off the heat-transfer between the first-stage cold head and the first cooling target terminal.

The cooling container can be easily switched between a state of allowing respective heat-transfers between the first-stage and second-stage cold heads of the refrigerator and the first and second cooling target terminals and a state of cutting off the heat-transfers, through a simple operation of raising and lowering the cylinder holder and the first cooling target terminals relatively to the container body by use of the first and second raising and lowering mechanisms, respectively, without requiring any special member such as a sleeve to be interposed between the refrigerator and the first and second cooling target terminals. This enables the refrigerator to efficiently cool the first and second cooling objects and enables the maintenance of the refrigerator to be easily performed.

Specifically, the cooling container can be brought into a state of allowing the first-stage cold head to cool the first cooling object in the container body through the first cooling target terminal and allowing the second-stage cold head to cool the second cooling object in the container body through the second cooling target terminal, namely, a normal cooling operation state, by lowering the cylinder holder to the second heat-transfer position, where the lower surface of the second-stage cold head of the refrigerator comes in contact with the second cooling target surface of the second cooling target terminal, by use of the second raising and lowering mechanism, in a state where the displacer is inserted into the cylinder of the refrigerator (that is, the refrigerator is assembled up) and further raising the first cooling target terminal to the first heat-transfer position, where the first cooling target surface of the first cooling target terminal comes in contact with the lower surface of the first-stage cold head of the refrigerator.

Respective heat-transfers between the first-stage and second-stage cold heads and the first and second cooling target terminals, conversely, can be cut off by lowering the first cooling target terminal to the first cut-off position, where the first cooling target surface of the first cooling target terminal is separated downward from the lower surface of the first-stage cold head of the refrigerator, by use of the first raising and lowering mechanism, and further raising the cylinder holder to the second cut-off position, where the lower surface of the second-stage cold head of the refrigerator is separated upward from the second cooling target surface of the second cooling target terminal, by use of the second raising and lowering mechanism. In this state, the maintenance of the displacer and the driving part can be performed while keeping the vacuum state and the low temperature state in the container body by separating the cylinder and the displacer from each other and taking out only the displacer and the driving part while leaving the cylinder still held by the cylinder holding part. Besides, the holder seal part keeps a vacuum state in the container body regardless of raising or lowering the cylinder holder relatively to the container body.

While the first raising and lowering mechanism and the second raising and lowering mechanism may be a linear drive mechanism such as a hydraulic cylinder device or an electromagnetic solenoid device, each of them prefereably includes a feed screw mechanism that converts a rotational operation applied to the feed screw mechanism into a raised or lowered motion of the cylinder holder or the first cooling target terminal. The feed screw mechanism allows the contact pressure of the lower surface of the second-stage cold head with the second cooling target surface or the contact of the first cooling target surface with the lower surface of the first-stage cold head to be adjusted by the rotational operation.

Specifically, the first raising and lowering mechanism preferably includes: a first screw member supported by the container body rotatably about a vertical axis, the first screw member including a first operation portion disposed outside the container body to allow a rotational operation to be applied to the first operation portion and a first screw portion formed with a screw that is vertically advanced along with the rotational operation; and a first raised and lowered body connected to the first cooling target terminal and supported by the container body so as to be raiseable and lowerable with the first cooling target terminal, the first raised and lowered body screw-engaged with the first screw portion so as to be raised and lowered along with the rotational operation applied to the first screw member.

More specifically, the first raised and lowered body preferably includes: a screw-engagement member disposed between an upper surface of the container body and the cylinder holder so as to be raiseable and lowerable and screw-engaged with the first screw portion; a screw-engaged member seal part which is interposed between the screw-engagememt member and the container body to seal the container body while allowing the screw-engagememt member to be raised and lowered relatively to the container body; and a connection member disposed in the container body to vertically interconnect the screw-engagememt member and the first cooling target terminal so as to cause the screw-engagememt member and the first cooling target terminal to be raised and lowered integrally with each other. The first raised and lowered body enables the first screw member to be disposed on the upper side of the container body. This enables the required length of the first screw member to be greatly reduced as compared with a mode in which the first screw member is directly connected to the first cooling target terminal. Besides, the screw-engagement member can be compactly arranged by effective utilization of the space between the container body and the cylinder holder. The screw-engaged member seal part, furthermore, keeps a vacuum state in the container body regardless of raising or lowering the screw-engagememt member.

For example, it is preferable that: the upper surface of the container body includes a vertically cylindrical first guide surface; the screw-engagement member includes a guided portion having a first guided surface fitted to the first guide surface so as to be guided vertically by the first guide surface; and the screw-engaged member seal part includes an annular first seal member interposed between the first guide surface and the first guided surface over an entire circumference of the first seal member. The combination of the first guide surface and the first guided surface enables the screw member to be raised and lowered in a stable state while keeping the vacuum state in the container body.

In this mode, it is more preferable that: the guided portion of the screw-engagement member further includes a vertically cylindrical second guide surface at a position radially outside or inside the first guided surface; the cylinder holder has a second guided surface fitted to the second guide surface so as to be guided vertically by the second guide surface; and the holder seal part includes an annular second seal member interposed between the second guide surface and the second guided surface. In this mode, the guided portion of the screw-engagement member can also serve as a guide portion for guiding the cylinder holder vertically to allow it to be stably raised and lowered.

On the other hand, it is preferable that: the second raising and lowering mechanism includes a second screw member rotatable about a vertical axis while being restrained from downward displacement relative to the container body, and the second screw member includes a second operation portion disposed above the cylinder holder and allowing a rotational operation to be applied to the second operation portion, and a second screw portion extending downward from the second operation portion to vertically penetrate the cylinder holder, the second screw portion screw-engaged with the cylinder holder so as to raise and lower the cylinder holder along with the rotational operation applied to the second operation portion in a specific direction. The second screw member can raise the cylinder holder and the cylinder held by the cylinder holder against the self weight of the cylinder holder and the refrigerator along with the rotational operation applied to the second operation portion. The above restraint of the second screw member from the downward displacement can be achieved, for example, by vertical abutment of the lower end of the second screw member against the first raised and lowered body or the container body.

Preferably, the second raising and lowering mechanism further includes a biasing mechanism that applies a downward biasing force to the cylinder holder. Although the contact between the lower surface of the second-stage cold head and the cooling target surface caused by lowering the cylinder holder and the cylinder held by the cylinder holder can be made, for example, by use of only the self weight of the refrigerator including the cylinder and the cylinder holder, the biasing mechanism makes the contact more reliable.

The biasing mechanism, preferably, includes a biasing-force operation part that changes the downward biasing force. The changeability of the biasing force facilitates the adjustment of the contact pressure between the lower surface of the second-stage cold head and the second cooling target surface.

Specifically, it is preferable that the biasing mechanism includes: a screw shaft fixed to the container body and penetrating the cylinder holder so as to allow the cylinder holder to be raised and lowered, the screw shaft including a male screw portion at least in a region on an upper side of the cylinder holder; a nut screw-engaged with the male screw portion at a position above the cylinder holder; and a spring member interposed between the nut and the cylinder holder while being elastically compression-deformed to provide an elastic force, which acts on the cylinder holder as the downward biasing force. The nut, being raised and lowered relatively to the screw shaft by the rotational operation applied to the nut, can change the elastic force of the spring member interposed between the nut and the cylinder holder, that is, the downward biasing force acting on the cylinder holder. This enables the contact pressure between the lower surface of the second-stage cold head and the cooling target surface to be easily adjusted.

Preferably, the second cooling target terminal further includes a guide portion provided on the second cooling target surface to guide a lower end of the second-stage cold head that is being lowered to the second cooling target surface to a predetermined position on the second cooling target surface. The guide part enables the lower surface of the second-stage cold head lowered together with the cylinder holding part by the second raising and lowering mechanism to be surely brought into contact with the second cooling target surface at a preferable position on the second cooling target surface.

The invention claimed is:

1. A cooling container that contains a first cooling object and a second cooling object for which a target cooling temperature lower than that of the first cooling object is set, the cooling container configured to support a refrigerator including a cylinder, a displacer inserted into the cylinder reciprocably and detachably from the cylinder, and a drive unit that reciprocates the displacer to generate cold heat, the displacer and the cylinder constituting a first-stage cold head having a first operation temperature and a second-stage cold head having a second operation temperature lower than the first operation temperature and aligned axially with the first-stage cold head, to allow the first cooling object and the second cooling object to be cooled by the first-stage cold head and the second-stage cold head, respectively, the cooling container comprising:

a container body that contains the first cooling object and the second cooling object while keeping a vacuum state;

a first cooling target terminal that is disposed in the container body while being heat-transferably connected to the first cooling object, the first cooling target terminal having a first cooling target surface that is opened upward;

a second cooling target terminal that is disposed in the container body while being heat-transferably connected to the second object and being raiseable and lowerable, the second cooling target terminal having a second cooling target surface that is opened upward at a position below the first cooling target surface;

a cylinder holder supported by the container body so as to be raiseable and lowerable with the cylinder while holding the cylinder in a posture where a lower surface of the first-stage cold head and a lower surface of the second-stage cold head are vertically opposed to the first cooling target surface and the second cooling target surface, respectively;

a holder seal part interposed between the container body and the cylinder holder to hermetically seal the container body while allowing the cylinder holder to be raised and lowered relatively to the container body;

a second raising and lowering mechanism connected to the cylinder holder to raise and lower the cylinder holder between a second heat-transfer position where the lower surface of the second-stage cold head comes in contact with the second cooling target surface to allow heat-transfer between the second-stage cold head and the second cooling target terminal and a second cut-off position where the lower surface of the second-stage cold head is separated upward from the second cooling target surface to cut off the heat-transfer between the second-stage cold head and the second cooling target terminal; and a first raising and lowering mechanism connected to the first cooling target terminal to raise and lower the first cooling target terminal between a first heat-transfer position where the first cooling target surface comes in contact with the lower surface of the first-stage cold head which is located at a height position corresponding to the second heat-transfer position to allow heat-transfer between the first-stage cold head and the first cooling target terminal and a first cut-off position where the first cooling target surface is separated downward from the lower surface of the first-stage cold head to cut off the heat-transfer between the first-stage cold head and the first cooling target terminal.

2. The cooling container according to claim 1, wherein the first raising and lowering mechanism includes a feed screw mechanism that converts a rotational operation, which is applied to the first raising and lowering mechanism, into a raised or lowered motion of the first cooling target terminal.

3. The cooling container according to claim 2, wherein the first raising and lowering mechanism includes: a first screw member supported by the container body rotatably about a vertical axis, the first screw member including a first operation portion disposed outside the container body to allow a rotational operation to be applied to the first operation portion and a first screw portion formed with a screw that is vertically advanced along with the rotational operation; and a first raised and lowered body connected to the first cooling target terminal and supported by the container body so as to be raiseable and lowerable with the first cooling target terminal, the first raised and lowered body being screw-engaged with the first screw portion so as to be raised and lowered along with the rotational operation applied to the first screw member.

4. The cooling container according to claim 3, wherein the first raised and lowered body includes: a screw-engagement member disposed between an upper surface of the container body and the cylinder holder so as to be raiseable and lowerable and screw-engaged with the first screw portion; a screw-engaged member seal part which is interposed between the screw-engagement member and the container body to seal the container body while allowing the screw-engagement member to be raised and lowered relatively to the container body; and a connection member disposed in the container body to vertically interconnect the screw-engagement member and the first cooling target terminal so as to cause the screw-engagement member and the first cooling target terminal to be raised and lowered integrally with each other.

5. The cooling container according to claim 4, wherein: the upper surface of the container body includes a vertically cylindrical first guide surface; the screw-engagement member includes a guided portion having a first guided surface fitted to the first guide surface so as to be guided vertically by the first guide surface; and the screw-engaged member seal part includes an annular first seal member interposed between the first guide surface and the first guided surface over an entire circumference of the first seal member.

6. The cooling container according to claim 5, wherein: the guided portion of the screw-engagement member further includes a vertically cylindrical second guide surface at a position radially outside or inside the first guided surface; the cylinder holder has a second guided surface fitted to the second guide surface so as to be guided vertically by the second guide surface; and the holder seal part includes an annular second seal member interposed between the second guide surface and the second guided surface.

7. The cooling container according to claim 1, wherein the second raising and lowering mechanism includes a feed screw mechanism that converts a rotational operation, which is applied to the feed screw mechanism, into a raised or lowered motion of the cylinder holder.

8. The cooling container according to claim 7, wherein the second raising and lowering mechanism includes a second screw member rotatable about a vertical axis while being restrained from downward displacement relative to the container body, the second screw member including a second operation portion disposed above the cylinder holder and allowing a rotational operation to be applied to the second operation portion, and a second screw portion extending downward from the second operation portion to vertically penetrate the cylinder holder, the second screw portion screw-engaged with the cylinder holder so as to raise and lower the cylinder holder along with the rotational operation applied to the second operation portion in a specific direction.

9. The cooling container according to claim 8, wherein the second raising and lowering mechanism further includes a biasing mechanism that applies downward biasing force to the cylinder holder.

10. The cooling container according to claim 9, wherein the biasing mechanism includes: a screw shaft fixed to the container body and penetrating the cylinder holder so as to allow the cylinder holder to be raised and lowered, the screw shaft including a male screw portion at least in a region on an upper side of the cylinder holder; a nut screw-engaged with the male screw portion at a position above the cylinder holder; and a spring member interposed between the nut and the cylinder holder while being elastically compression-deformed to provide an elastic force, which acts on the cylinder holder as the downward biasing force.

11. The cooling container according to claim 1, wherein the second cooling target terminal further includes a guide portion provided on the second cooling target surface to guide a lower end of the second-stage cold head that is being lowered to the second cooling target surface to a predetermined position on the second cooling target surface.

* * * * *